US010010462B1

(12) United States Patent
Rios

(10) Patent No.: US 10,010,462 B1
(45) Date of Patent: Jul. 3, 2018

(54) FOOT SUPPORT FOR A WHEELCHAIR

(71) Applicant: Carlos Antonio Rios, St. Petersburg, FL (US)

(72) Inventor: Carlos Antonio Rios, St. Petersburg, FL (US)

( * ) Notice: Subject to any disclaimer, the term of this patent is extended or adjusted under 35 U.S.C. 154(b) by 0 days.

(21) Appl. No.: 15/375,009

(22) Filed: Dec. 9, 2016

(51) Int. Cl.
*A61G 5/12* (2006.01)
*A47C 7/50* (2006.01)

(52) U.S. Cl.
CPC ..... *A61G 5/128* (2016.11); *A47C 7/503* (2013.01)

(58) Field of Classification Search
CPC .. A61G 5/12; A61G 5/128; A47C 7/50; A47C 7/503; A47C 7/506; A47C 7/52; A47C 16/02; A47C 16/025
USPC ..... 297/423.2, 423.4
See application file for complete search history.

(56) References Cited

U.S. PATENT DOCUMENTS 5,312,161 A * 5/1994 Mars ..... A47C 7/506 297/423.2
8,191,913 B1 * 6/2012 Jessome ..... A61G 5/12 280/250.1
9,155,394 B1 * 10/2015 Cohen ..... A47C 7/506
2014/0265234 A1 * 9/2014 Beck ..... A61G 5/12 280/291
2016/0095444 A1 * 4/2016 Gredinger ..... A47C 7/506 297/423.4

FOREIGN PATENT DOCUMENTS

GB 820651 A * 9/1959 ..... A61G 5/12

* cited by examiner

*Primary Examiner* — Ryan D Kwiecinski
(74) *Attorney, Agent, or Firm* — Tiffany C. Miller; Inventions International Inc.

(57) ABSTRACT

A foot support connected to the frame of a wheelchair having a housing having a primary end located opposite a secondary end with a central bore. The central bore of the housing retains a rod. The housing has at least one opening. The opening of the housing reveals a revealed portion of the rod when the rod slidably traverses at least a portion of the length of the housing. A support structure is in communication with the revealed portion of the rod. The support structure supports the weight of a user's feet when a user is seated in the wheelchair. The support structure slidably traverses the length of the opening of the housing. When the support structure is oriented in a position located under the seat of the wheelchair, the rod is retracted within the central bore of the housing located substantially near the secondary end of the housing.

7 Claims, 4 Drawing Sheets

FOOT SUPPORT FOR A WHEELCHAIR

BACKGROUND OF THE INVENTION

1. Field of the Invention

This invention relates, generally, to a foot support for a wheelchair. More particularly, it relates to a foot support having two rods that are configured to slidably traverse at least a portion of a length of a housing connected to a wheelchair frame that is located under a seat of a wheelchair.

2. Background Art

Currently, many wheelchairs in today's market do not have footrests. There is a need for a footrest that can be removably mounted to a wheelchair to support and retain a user's feet while a user is seated in the wheelchair. It is more desirable for a user's feet to be elevated when a user is in a seated position rather than a user's feet being dragged on the ground when the wheelchair is in use. For example, in an emergency situation, a patient may need to be moved around in the wheelchair quickly. Thus, there is a need for a novel foot support that is connected to the frame of the wheelchair to elevate a user's feet, resulting in a quicker and safer transport of the patient.

Commonly, wheelchairs can have removable traditional footrests having a front rigging and a footplate configured to support the weight of a user's foot. These traditional footrests can be bulky which can make it difficult to store the footrests when not in use. Also, when installed onto the front portion of the frame of a wheelchair, these traditional footrests can obstruct the path of a user trying to sit in or get up from the wheelchair. Thus, there is a need for a novel space-saving footrest connected to the frame of a wheelchair that can be retracted under the wheelchair seat resulting in the footrest being discretely stored away when not in use. As a further result, in a retracted orientation, the novel footrest does not obstruct the path of a user when the foot rest is not in use.

More particularly, the novel footrest offers a space saving storage solution to wheelchair footrests which eliminates the need for traditional footrests to be completely removed from a wheelchair when not in use and eliminates the need to maneuver around the bulkiness of the traditional footrest when installed onto a wheelchair. There is a need for a novel footrest that decreases the probability that a user may trip on the footrest and decreases the probability that the footrest may collide with and damage surrounding objects. It is more desirable for a wheelchair to have a footrest connected to the wheelchair frame in which the footrest can retract under the seat of a wheelchair when not in use and extend from underneath the wheelchair seat when in use. The novel footrest can be easily stored under the seat of the wheelchair so that the footrest is out of the way and does not take up valuable space when not in use.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a foot support for a wheelchair having a housing having a primary end located opposite a secondary end with a central bore. The housing is connected to the frame of the wheelchair located under the seat portion of the wheelchair. The central bore of the housing retains a rod. The housing has at least one opening. The opening of the housing reveals a revealed portion of the rod when the rod slidably traverses at least a portion of the length of the housing. A support structure is in communication with the revealed portion of the rod. The support structure supports the weight of a user's feet when a user is seated in the wheelchair. The rod supporting the support structure slidably traverses the length of the opening of the housing. When the support structure is oriented in a position located under the seat of the wheelchair, the rod is retracted within the central bore of the housing located substantially near the secondary end of the housing, and which also includes improvements that overcome the limitations of prior art wheelchair footrests is now met by a new, useful, and non-obvious invention.

In a preferred embodiment, the novel foot support for a wheelchair has a housing having a central bore. The housing is connected to at least a portion of the wheelchair. It is within the scope of this invention for the housing to be connected to the wheelchair with at least one fastener including, but not limited to, an integral conforming ridge, a clamp, a tie-strap, a latch, adhesive, hook and loop attachments, a grip, a snap, a cable, a chain, a rope, or a screw. The housing can be integrally formed into the structure of the wheelchair or the housing can be removably attached to the frame of a wheelchair. The housing can have a primary end located opposite a secondary end. The housing can have at least one opening.

The foot support has a rod having a primary end located opposite a secondary end. The rod is retained by the central bore of the housing. The rod slidably traverses at least a portion of the length of the housing, whereby, the revealed portion of the rod is revealed within at least one opening of the housing.

The support structure is configured to support the weight of a user's foot when the user is seated in the seat of the wheelchair. At least a portion of the support structure is in communication with the revealed portion of the rod. In a preferred embodiment, a portion of the support structure is connected to the rod. It is also within the scope of this invention for at least one fastener to connect the support structure to the rod. It is within the scope of this invention for a fastener to include, but not be limited to, a clip, a hook, a clamp, a link, a chain, a rope, a length of a pliable material.

The rod supporting the support structure slidably traverses the length of the at least one opening of the housing. At least a portion of the support structure is oriented in a position located under the seat of the wheelchair when the rod is retracted within the central bore located substantially near the secondary end of the housing. At least a portion of the support structure is oriented in a position that is not located under the seat of the wheelchair when the rod traverses at least a portion of the length of the housing located substantially toward the primary end of the housing.

In an alternate embodiment, the novel foot support for a wheelchair can have a rod having at least one anchor structure. The at least one anchor structure has an opening. The at least one anchor structure protrudes from the revealed portion of the rod. The at least one anchor structure is configured to communicate with the support structure. In an example, a clip can have one end connected through the anchor structure's opening and the clip can have another end connected to the support structure or an anchor structure of the support structure. In another example, a portion of the support structure can connect to the anchor structure of the rod without a fastener.

In an alternate embodiment, the support structure can have a primary end having a primary opening located opposite a secondary end having a primary opening. The primary opening of the primary end of the support structure forms a primary compartment and the primary opening of the secondary end of the support structure forms a secondary compartment. A primary retainer has a primary retainer end located opposite a secondary retainer end. The primary retainer is retained by the primary compartment. At least a portion of the primary retainer end of the primary retainer and at least a portion of the secondary retainer end of the primary retainer protrudes from the primary compartment. A secondary retainer has a primary retainer end located opposite a secondary retainer end. The secondary retainer is retained by the secondary compartment. At least a portion of the primary retainer end of the secondary retainer and at least a portion of the secondary retainer end of the secondary retainer protrudes from the secondary compartment.

In an alternate embodiment, a primary fastener is connected to the primary retainer end of the primary retainer. A secondary fastener is connected to the secondary retainer end of the primary retainer. A tertiary fastener is connected to the primary retainer end of the secondary retainer. A quaternary fastener is connected to the secondary retainer end of the secondary retainer. The primary fastener and the secondary fastener are both connected to a first rod. The tertiary fastener and the quaternary fastener are both connected to a second rod.

In another embodiment, the novel foot support has a housing having a central bore. The housing is connected to at least a portion of the wheelchair. The housing has a primary end located opposite a secondary end. The primary end of the housing has a primary opening. The housing has a rod having a primary end located opposite a secondary end. The rod is retained by the central bore of the housing. The rod slidably traverses at least a portion of a length of the housing. The primary end of the rod is configured to protrude from the primary opening of the primary end of the housing. The housing has a support structure. At least a portion of the support structure is in communication with at least a portion of the rod. The support structure is configured to support the weight of a user's foot when the user is seated on the seat of the wheelchair. At least a portion of the support structure is oriented in a position located under the seat of the wheelchair when the rod is retracted within the central bore of the housing. At least a portion of the support structure is oriented in a position that is not located under the seat of the wheelchair when the rod traverses at least a portion of the length of the housing.

In another embodiment, the novel foot support for a wheelchair has a housing with a secondary opening located on an outer wall surface of the housing. A revealed portion of the rod is revealed within the secondary opening of the housing. The support structure is in communication with the revealed portion of the rod within the secondary opening. The rod slidably traverses the length of the secondary opening of the housing. The rod can have at least one anchor structure. The at least one anchor structure protrudes from a wall surface of the revealed portion of the rod located within the secondary opening of the housing.

In another embodiment, the novel foot support for a wheelchair has a housing having a central bore. The housing is connected to at least a portion of the wheelchair. It is a preferred embodiment for the housing to be connected to the wheelchair frame that is located under the seat of the wheelchair. The housing has a primary end located opposite a secondary end. The housing has a primary opening located on an outer wall surface of the housing. A rod having a primary end located opposite a secondary end is retained by the central bore of the housing. The rod slidably traverses at least a portion of a length of the housing.

The primary opening of the housing reveals a revealed portion of the rod when the rod is retained within the central bore of the housing. A support structure is in communication with the revealed portion of the rod. The rod supporting the support structure slidably traverses the length of the primary opening of the housing. The support structure is configured to support the weight of a user's foot. At least a portion of the support structure is oriented in a position located under a seat of the wheelchair when the rod is retracted within the central bore of the housing. At least a portion of the support structure is oriented in a position that is not located under the seat of the wheelchair when the rod traverses at least a portion of the length of the housing.

In an alternate embodiment, the primary end of the housing has a secondary opening. The primary end of the rod is configured to protrude from the secondary opening of the housing.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which forms a part hereof, and within which is shown by way of illustration specific embodiments by which the invention may be practiced. It is to be understood that other embodiments may be utilized and structural changes may be made without departing from the scope of the invention.

Figure 1:
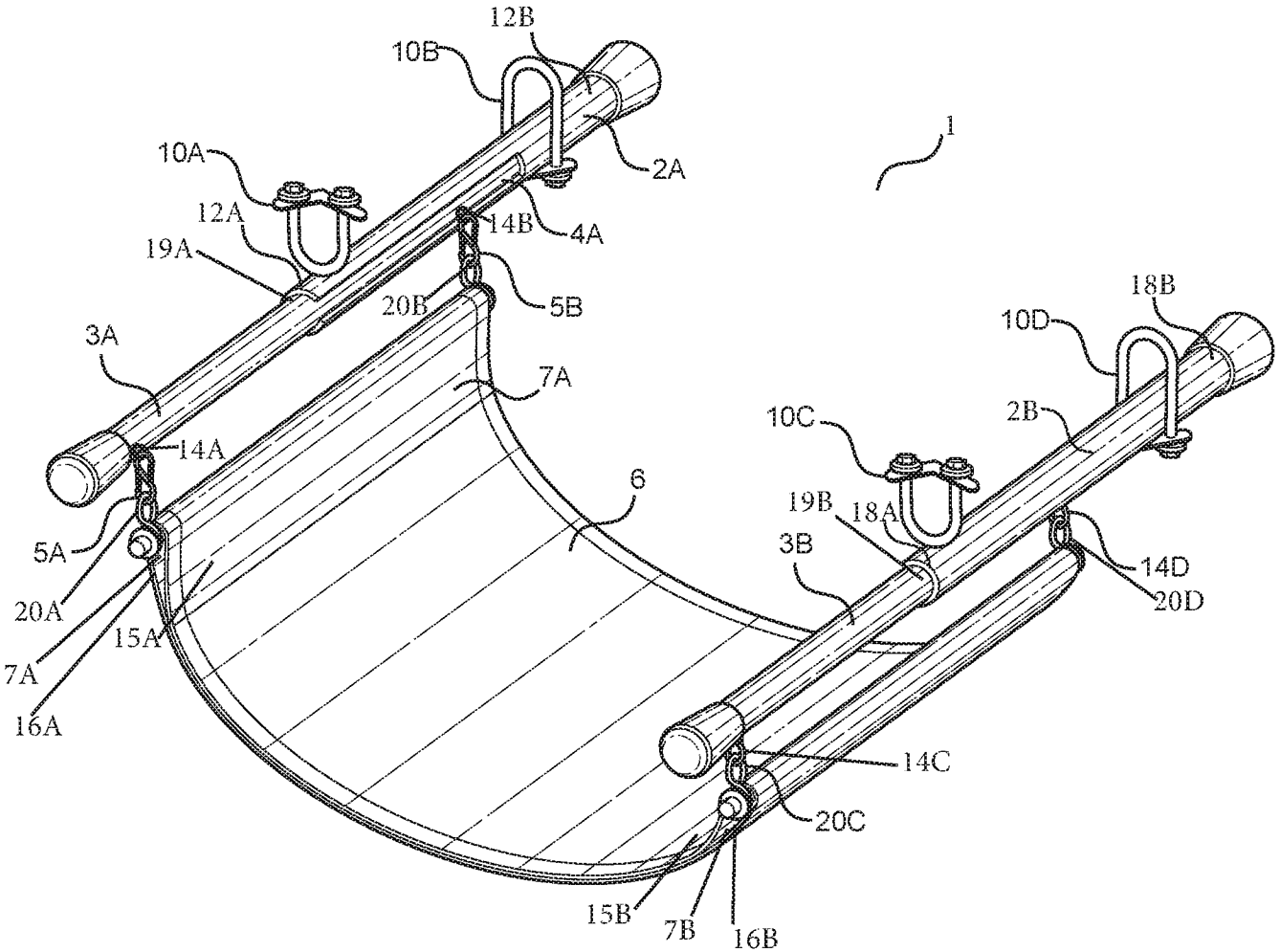
FIG. 1 is a perspective view of the novel foot support for a wheelchair.
Figure 2:
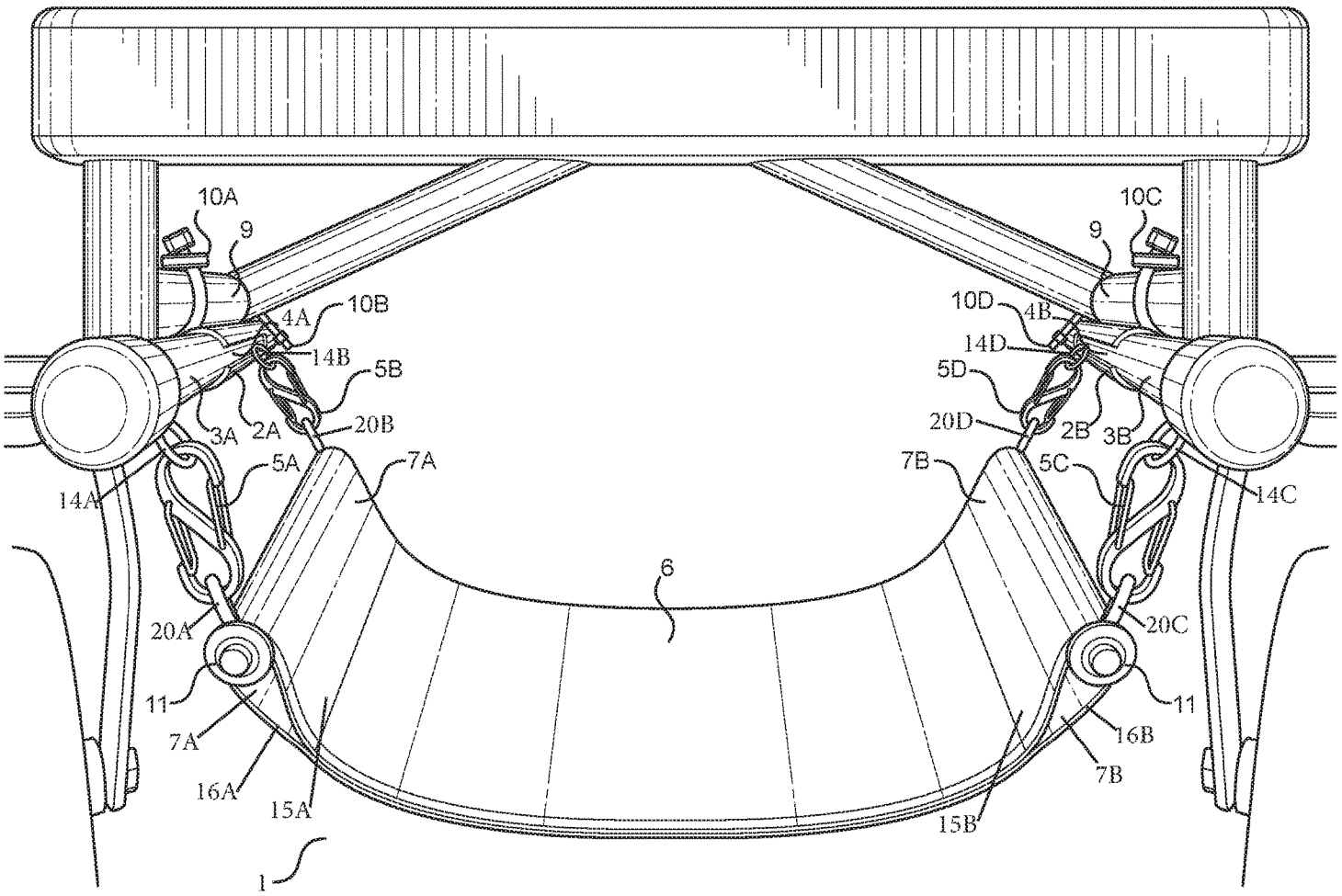
FIG. 2 is a front perspective view of the novel foot support connected to the frame of a wheelchair.
Figure 3:
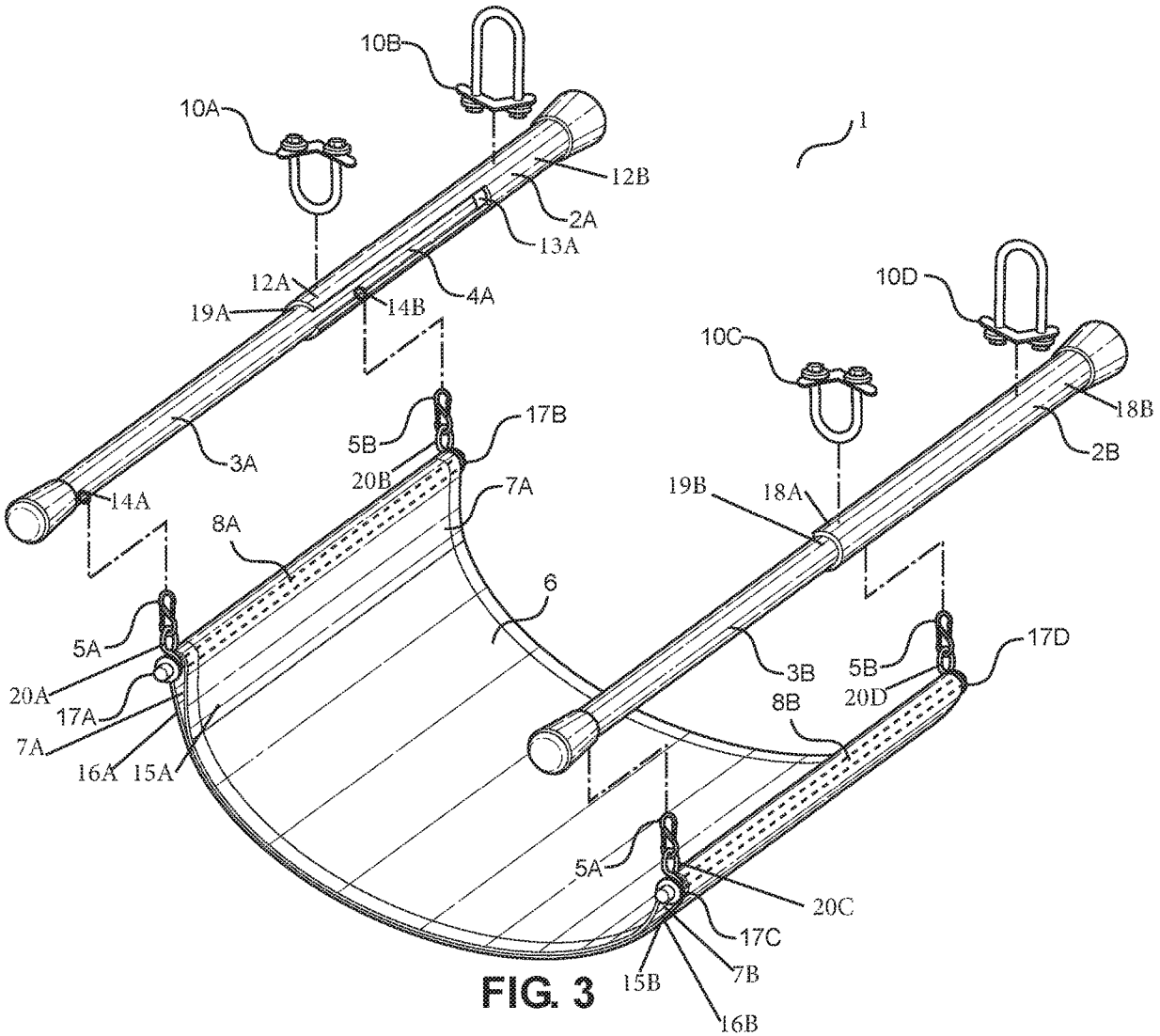
FIG. 3 is an exploded view of the novel foot support for a wheelchair.

It will now be seen, referring to FIGS. 1-3, foot support 1 has housing 2A and housing 2B. Housing 2A has primary end 12A (FIGS. 1 and 3) located opposite secondary end 12B (FIGS. 1 and 3). Housing 2B has primary end 18A (FIGS. 1 and 3) located opposite secondary end 18B (FIGS. 1 and 3). Housing 2A has central bore 13A FIG. 3. Housing 2B has central bore (not shown). Housing 2A has opening 4A (FIGS. 1-3) and housing 2B has opening 4B (FIG. 2). Opening 4A and opening 4B can be located at least a portion of the length of housing 2A and 2B. It is within the scope of the current invention for the opening 4A and 4B to extend to the end of the housing 2. For example, FIGS. 1 and 3 illustrate housing 2A with primary end 12A having opening 19A and housing 2B with primary end 18A having opening 19B.

Housing 2A retains rod 3A and Housing 2B retains rod 3B. As best illustrated in FIGS. 1 and 2, anchor structures 14A and 14B are connected to rod 3A and anchor structures 14C and 14D are connected to rod 3B. Further, anchor structures 14A and 14B protrude from an outer wall surface of rod 3A. Anchor structures 14C and 14 D protrude from an outer wall surface of rod 3B. FIG. 2 shows anchor structure 14A having an opening to receive a portion of fastener 5A, anchor structure 14B has an opening to receive a portion of fastener 5B, anchor structure 14C has an opening to receive a portion of fastener 5C, and anchor structure 14D has an opening to receive a portion of fastener 5D.

Figure 4:
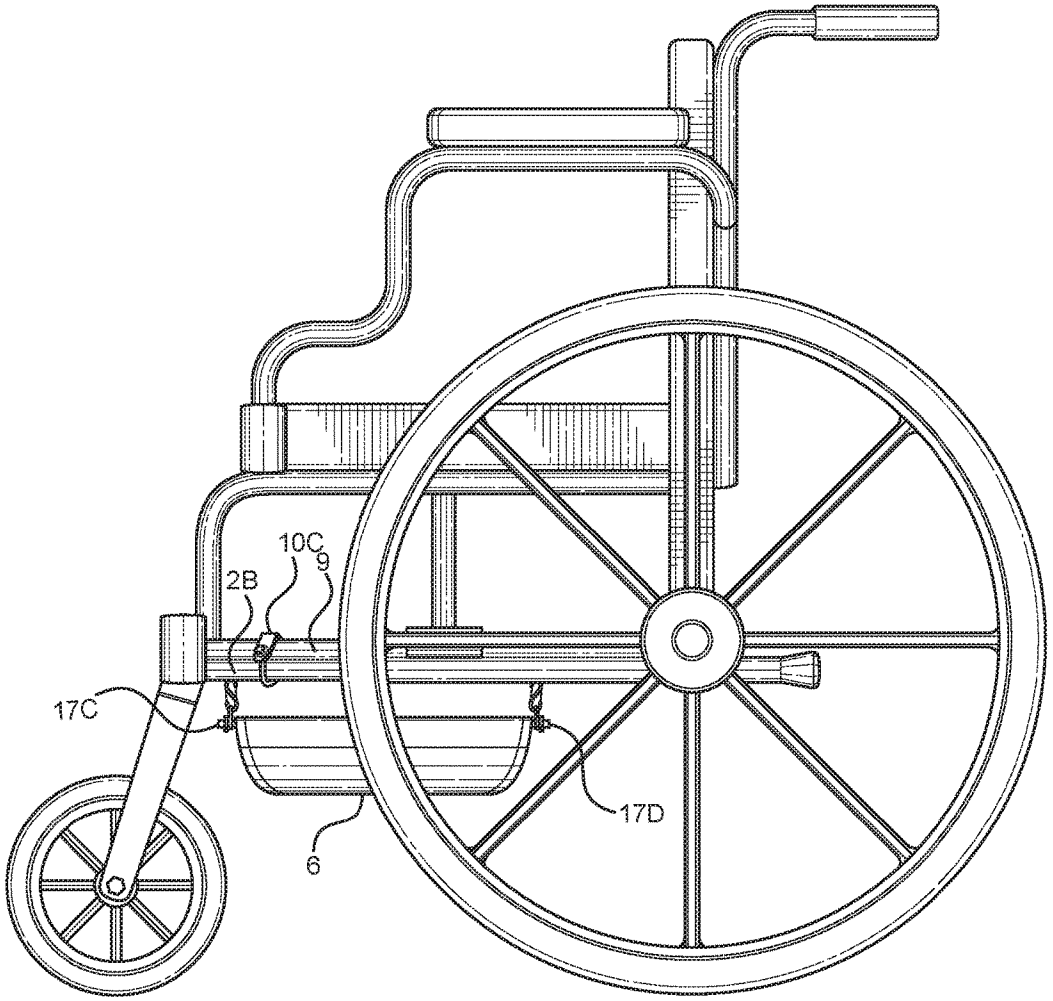
FIG. 4 is a side view of the novel foot support in a retracted orientation connected to the frame of a wheelchair and being located under the seat portion of the wheelchair.

FIG. 3 best shows support structure 6 having primary retainer 8A and secondary retainer 8B. FIG. 3 best shows, primary retainer 8A having primary end 17A located opposite secondary end 17B. FIGS. 3 and 4 best illustrate secondary retainer 8B of support structure 6 having primary end 17C located opposite secondary end 17D. The retainer ends can be removable such as a threaded fastener. FIGS. 1-3 depict support structure 6 having primary end 15A located opposite secondary end 15B. Primary end 15A of support structure 6 has primary opening 16A forming compartment 7A. Secondary end 15B of support structure 6 has secondary opening 16B forming compartment 7B. A portion of primary retainer 8A (FIG. 3) is located within primary compartment 7A. A portion of secondary retainer 8B (FIG. 3) is located within secondary compartment 7B.

It is within the scope of this invention for primary retainer 8A and secondary retainer 8B to have an anchoring structure connected thereto. For example, FIGS. 1 and 3 show primary retainer 8A (FIG. 3) is connected to anchoring structures 20A and 20B and secondary retainer 8B (FIG. 3) is connected to anchoring structures 20C and 20D. FIG. 1 shows an embodiment of anchoring structure 20C of secondary retainer 8B is connected to anchoring structure 14C of secondary rod 3B and anchoring structure 20D of secondary retainer 8B is connected to anchoring structure 14D of secondary rod 3B.

FIGS. 1 and 2 illustrate another embodiment of anchoring structure 20A of primary retainer 8A is connected to primary fastener 5A, whereby, primary fastener 5A is connected to primary anchor structure 14A of primary rod 3A. Anchoring structure 20B of primary retainer 8A is connected to secondary fastener 5B, whereby, secondary fastener 5B is connected to secondary anchor structure 14B of primary rod 3A. FIG. 2 illustrates anchoring structure 20C of secondary retainer 8B is connected to tertiary fastener 5C, whereby, tertiary fastener 5C is connected to primary anchor structure 14C of secondary rod 3B. Anchoring structure 20D of secondary retainer 8B is connected to quaternary fastener 5D, whereby, quaternary fastener 5D is connected to secondary anchor structure 14D of secondary rod 3B. FIG. 2 shows retainer ends can have a retaining member including, but not limited to, a washer 11. Washer 11 can be connected to the retainer end to keep anchor structures secured onto the retainer or to keep the retainer positioned within the formed compartment of the support structure. Although not a preferred embodiment, it is within the scope of this invention for the fasteners 5 to not need anchoring structures to connect the rod to the support structure.

FIG. 2 shows foot support 1 is connected to wheelchair frame 9 with fastener 10. In particular, FIGS. 1-3 show fastener 10A and fastener 10B are configured to connect primary housing 2A to a portion of wheelchair frame 9 (FIG. 2). FIGS. 1-4 show fastener 10C and fastener 10D (FIGS. 1-3) are configured to connect secondary housing 2B to a portion of a wheelchair frame 9.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying diagram shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A foot support for a wheelchair, comprising:

a housing, said housing having a central bore, said housing is connected to at least a portion of said wheelchair, said housing having a first end located opposite a second end, said first end of said housing having a first opening;

a rod, said rod having a first end located opposite a second end, said rod is retained by said central bore of said housing, said rod slidably traverses at least a portion of a length of said housing, whereby, said first end of said rod is configured to protrude from said first opening of said first end of said housing, said housing having a second opening located on an outer wall surface of said housing, whereby, a revealed portion of said rod is revealed within said second opening of said housing, said rod having at least one anchor structure, said at least one anchor structure has an opening, said at least one anchor structure protruding from said revealed portion of said rod, said at least one anchor structure of said rod is connected to a support structure; and, said support structure is configured to support the weight of a user's foot, at least a portion of said support structure is oriented in a position located under a seat of said wheelchair when said rod is retracted within said central bore of said housing, at least a portion of said support structure is oriented in a position not located under said seat of said wheelchair when said rod traverses said at least a portion of the length of said housing.

2. The foot support for a wheelchair of claim 1, further comprising said support structure comprising, a first end having a first opening located opposite a second end having a first opening, whereby, said first opening of said first end of said support structure forming a first compartment and said first opening of said second end of said support structure forming a second compartment;

a first retainer having a first retainer end located opposite a second retainer end, said first retainer is retained by said first compartment, at least a portion of said first retainer end of said first retainer and at least a portion of said second retainer end of said first retainer protrudes from said first compartment; and, a second retainer having a first retainer end located opposite a second retainer end, said second retainer is retained by said second compartment, at least a portion of said first retainer end of said second retainer and at least a portion of said second retainer end of said second retainer protrudes from said second compartment.

3. A foot support for a wheelchair, comprising:

a housing, said housing having a central bore, said housing is connected to at least a portion of said wheelchair, said housing having a first end located opposite a second end, said housing having a first opening located on an outer wall surface of said housing;

a rod, said rod having a first end located opposite a second end, said rod is retained by said central bore of said housing, said rod slidably traverses at least a portion of a length of said housing, whereby, said first opening of said housing reveals a revealed portion of said rod when said rod is retained within said central bore of said housing, said rod having at least one anchor structure, said at least one anchor structure protruding from a wall surface of said revealed portion of said rod; and, a support structure, said support structure is connected to said at least one anchor structure of said revealed portion of said rod, whereby, said support structure slidably traverses a length of said first opening of said housing, said support structure is configured to support the weight of a user's foot, at least a portion of said support structure is oriented in a position located under a seat of said wheelchair when said rod is retracted within said central bore of said housing, at least a portion of said support structure is oriented in a position not located under said seat of said wheelchair when said rod traverses said at least a portion of the length of said housing.

4. The foot support for a wheelchair of claim 3, further comprising said first end of said housing having a second opening, whereby, said first end of said rod is configured to protrude from said second opening of said housing.

5. The foot support for a wheelchair of claim 3, further comprising said support structure comprising, a first end having a first opening located opposite a second end having a first opening, whereby, said first opening of said first end of said support structure forming a first compartment and said first opening of said second end of said support structure forming a second compartment;

a first retainer having a first retainer end located opposite a second retainer end, said first retainer is configured to be retained by said first compartment, at least a portion of said first retainer end of said first retainer and at least a portion of said second retainer end of said first retainer protrudes from said first compartment; and, a second retainer having a first retainer end located opposite a second retainer end, said second retainer is configured to be retained by said second compartment, at least a portion of said first retainer end of said second retainer and at least a portion of said second retainer end of said second retainer protrudes from said second compartment.

6. A foot support for a wheelchair, comprising:

a housing, said housing having a central bore, said housing is connected to at least a portion of said wheelchair, said housing having a first end located opposite a second end, said housing having at least one opening;

a rod, said rod having a first end located opposite a second end, said rod is retained by said central bore of said housing, said rod slidably traverses at least a portion of a length of said housing, whereby, a revealed portion of said rod is revealed within said at least one opening of said housing said rod having at least one anchor structure, said at least one anchor structure has an opening, said at least one anchor structure protruding from said revealed portion of said rod, said at least one anchor structure is connected to a support structure; and, said support structure is configured to support the weight of a user's foot, said support structure slidably traverses a length of said at least one opening of said housing, thereby, at least a portion of said support structure is oriented in a position located under a seat of said wheelchair when said rod is retracted within said central bore located substantially near said second end of said housing, at least a portion of said support structure is oriented in a position not located under said seat of said wheelchair when said rod traverses said at least a portion of the length of said housing located substantially toward said first end of said housing.

7. The foot support for a wheelchair of claim 6, further comprising said support structure comprising, a first end having a first opening located opposite a second end having a first opening, whereby, said first opening of said first end of said support structure forming a first compartment and said first opening of said second end of said support structure forming a second compartment;

a first retainer having a first retainer end located opposite a second retainer end, said first retainer is retained by said first compartment, at least a portion of said first retainer end of said first retainer and at least a portion of said second retainer end of said first retainer protrudes from said first compartment; and, a second retainer having a first retainer end located opposite a second retainer end, said second retainer is retained by said second compartment, at least a portion of said first retainer end of said second retainer and at least a portion of said second retainer end of said second retainer protrudes from said second compartment.

* * * * *